US010516198B2

(12) United States Patent
Koh et al.

(10) Patent No.: US 10,516,198 B2
(45) Date of Patent: Dec. 24, 2019

(54) WAVEGUIDE CONNECTOR COUPLERS AND ADAPTERS

(71) Applicant: Quantum Microwave Components, LLC, Hingham, MA (US)

(72) Inventors: Christopher T. Koh, Amherst, MA (US); Francis T. Koh, Downington, PA (US); Andrew Cobin, Hingham, MA (US)

(73) Assignee: Quantum Microwave Components, LLC, Hingham, MA (US)

( * ) Notice: Subject to any disclaimer, the term of this patent is extended or adjusted under 35 U.S.C. 154(b) by 80 days.

(21) Appl. No.: 15/833,740

(22) Filed: Dec. 6, 2017

(65) Prior Publication Data

US 2018/0323487 A1 Nov. 8, 2018

Related U.S. Application Data

(60) Provisional application No. 62/602,783, filed on May 8, 2017.

(51) Int. Cl.
*H01P 5/02* (2006.01)
*H01P 1/04* (2006.01)

(52) U.S. Cl.
CPC ..... *H01P 5/02* (2013.01); *H01P 1/042* (2013.01); *H01P 5/024* (2013.01)

(58) Field of Classification Search
CPC ..... H01P 5/02; H01P 1/042; H01P 5/024
USPC ..... 333/24 R, 245, 248, 254, 255, 260
See application file for complete search history.

(56) References Cited

U.S. PATENT DOCUMENTS 3,821,670 A 6/1974 Thompson
4,686,498 A * 8/1987 Carr ..... H01P 5/08 333/255
4,962,991 A 10/1990 Carvalho

OTHER PUBLICATIONS

[No Author Listed], WG Quick Disconnects & Dust Covers. L3 Narda ATM. http://www.atmmicrowave.com/waveguide/quick-disconnect/ 2016. last accessed Dec. 12, 2017. 4 pages.
[No Author Listed], Advanced Technical Materials, Inc. QD-42HQ Quick Disconnect Data Sheet. Drawn Nov. 7, 2014. 1 page.

* cited by examiner

*Primary Examiner* — Rakesh B Patel
*Assistant Examiner* — Jorge L Salazar, Jr.
(74) *Attorney, Agent, or Firm* — Wolf, Greenfield & Sacks, P.C.

(57) ABSTRACT

A waveguide connector assembly for coupling a waveguide to a microwave device includes a male part and a female part. The male part includes a threaded external cylindrical surface defining a male center axis, a first end surface, and a second end surface opposed to the first end surface. The female part includes a first annular end surface, a second annular end surface opposed to the first annular surface, a threaded internal cylindrical surface configured to engage with the threaded external cylindrical surface of the male part, and a gap in the threaded internal cylindrical surface from the first end annular end surface to the second annular end surface, and extends in a female radial direction the entire width of the first annular end surface and the second annular end surface.

20 Claims, 15 Drawing Sheets

SECTION A-A

WAVEGUIDE CONNECTOR COUPLERS AND ADAPTERS

RELATED APPLICATIONS

This application claims the benefit under 35 U.S.C. § 119(e) of U.S. Provisional Patent Application 62/602,783, entitled "Quick Connecting Waveguide Coupling," and filed on May 8, 2017, which is incorporated by reference in its entirety.

BACKGROUND

Microwave radiation is used in many different applications, such as radar, communications, information processing and other industrial uses. Applications that require microwave radiation at a particular location or radiated in a particular way or to a particular location often use waveguides to guide the microwave radiation. Microwave waveguides come in a variety of standard sizes. To build different microwave devices, multiple waveguide components are connected together. To create high quality microwave devices, the connections between different waveguide components require precise alignment of the waveguides to reduce loss and avoid affecting the mode of the guided microwave radiation.

BRIEF SUMMARY

According to one aspect of the present application, a waveguide connector assembly for coupling a waveguide to a microwave device, the waveguide including at least one flange at an end of the waveguide, is provided. The waveguide assembly includes a male part and a female part. The male part includes a threaded external cylindrical surface defining a male center axis that defines a male axial direction; a first end surface; and a second end surface opposed to the first end surface. The female part includes a first annular end surface; a second annular end surface opposed to the first annular surface, wherein a center of the first annular end surface and a center of the second annular end surface define a female center axis that defines a female axial direction; a threaded internal cylindrical surface configured to engage with the threaded external cylindrical surface of the male part, the internal cylindrical surface including an inner radius of the first annular end surface; a hollow internal space defined by the threaded internal cylindrical surface, wherein the hollow internal space has a width and height that are both larger than a largest cross-sectional dimension of the first waveguide; and a gap in the threaded internal cylindrical surface that extends in the female axial direction from the first end annular end surface to the second annular end surface, and extends in a female radial direction the entire width of the first annular end surface and the second annular end surface, wherein the gap is wider than a width of the waveguide.

According to one aspect of the present application, a female locking mechanism for coupling a waveguide to a microwave device, the waveguide including at least one flange at an end of the waveguide, is provided. The female locking mechanism includes an first annular end surface; a second annular end surface opposed to the first annular surface, wherein a center of the first annular end surface and a center of the second annular end surface define a female center axis that defines a female axial direction; and a threaded internal cylindrical surface including an inner radius of the first annular end surface; a hollow internal space defined by the threaded internal cylindrical surface, wherein the hollow internal space has a width and height that are both larger than a largest cross-sectional dimension of the first waveguide; and a gap in the threaded internal cylindrical surface that extends in the female axial direction from the first end annular end surface to the second annular end surface, and extends in a female radial direction an entire radial width of the first annular end surface and an entire radial width of the second annular end surface, wherein the gap is wider than a width of the waveguide.

The foregoing is a non-limiting summary of the invention, which is defined by the appended claims.

BRIEF DESCRIPTION OF DRAWINGS

The accompanying drawings are not necessarily drawn to scale. For the purposes of clarity, not every component may be labeled in every drawing. In the drawings.

DETAILED DESCRIPTION

Figure 1:
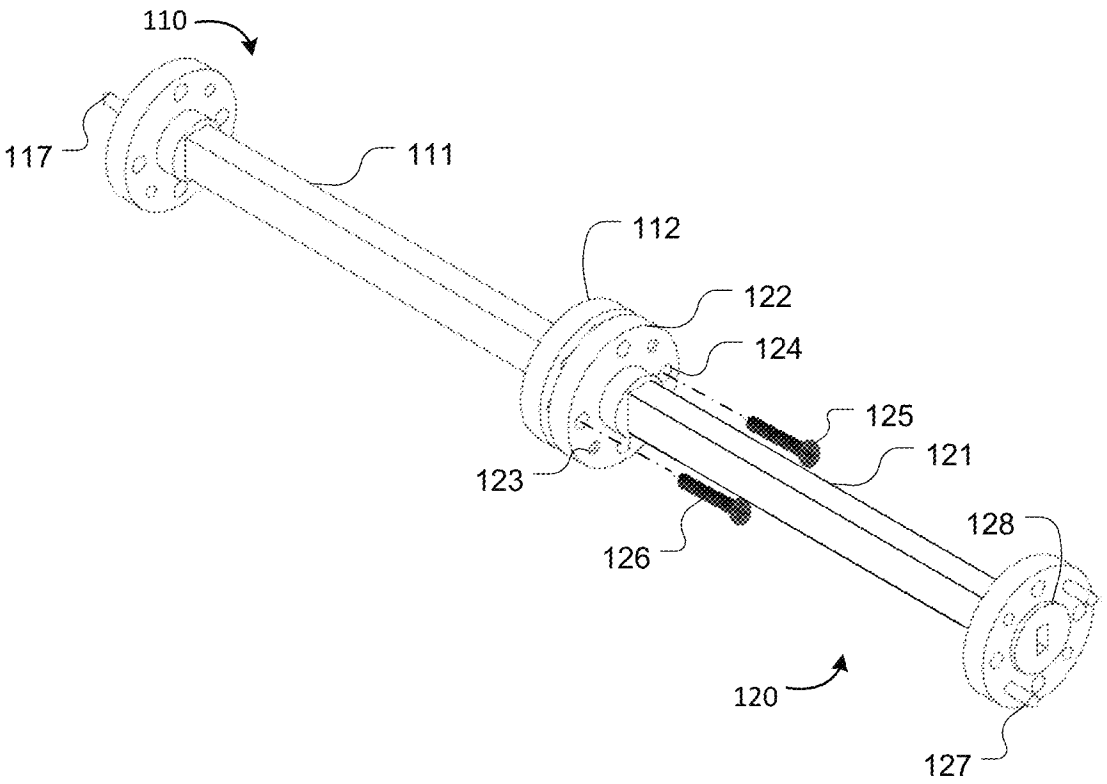
FIG. 1 Prior Art
FIG. 1 is a perspective view of a two waveguide components being connected according to the prior art.
Figure 2:
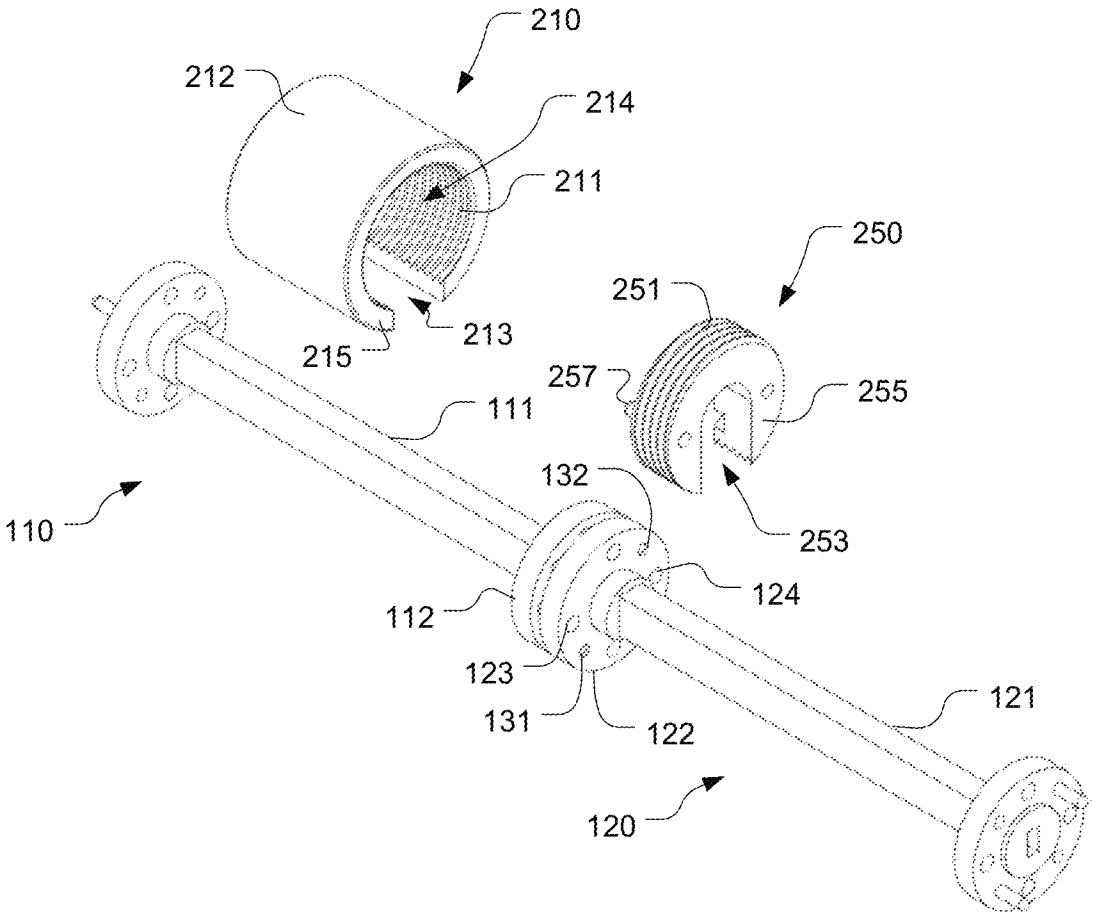
FIG. 2 is a perspective view of a waveguide connector assembly, according to some embodiments, prior to engaging with two waveguide components.

A conventional technique for coupling two waveguides is depicted in FIG. 1. A first waveguide component 110 and a second waveguide component 120 include a first rectangular waveguide portion 111 and a second rectangular waveguide portion 121, respectively. The rectangular waveguide portions 111 and 112 are typically a standard size based on the frequency of the microwave radiation being guided. At the end of each of the rectangular waveguide portions 111 and 121 is a flange 112 and 122, respectively. To couple the microwave radiation from the first rectangular waveguide portion 111 to the second rectangular waveguide portions 121 an end portion of the rectangular waveguide portions 111 is placed in surface contact with an end portion of the rectangular waveguide portion 121. The end portion 128 is an example of the end portion of the rectangular waveguide portion 121, which extends from the surface of the associated flange by a particular distance. Thus, then the end portion of the first rectangular waveguide portion 111 is brought in contact with the end portion of the second rectangular waveguide portion 121, the flange 112 and the flange 122 are not in contact with one another.

The flanges of the two waveguide components 110 and 120 may be aligned using one or more alignment pins 117 of the first waveguide component 110 and one or more alignment pins 127 of the second waveguide component 120. The alignment pins are sized and shaped to fit into alignment holes, such as alignment hole 123 formed in the flange 122. Once aligned, the first waveguide component 110 is affixed to the second waveguide component 120 using screws 125 and 126. The screw 125 fit into a threaded hole 124 of the flange 122 and into a corresponding threaded hole of flange 112 (not visible in FIG. 1). Once the screws 125 and 126 are tightened, the first rectangular waveguide 111 is coupled to the second rectangular waveguide 121.

The inventors have recognized and appreciated that convention connectors used to mate two microwave waveguides together result in poor mating and are time consuming to use. Screwing multiple screws into the small threaded holes of the flanges of the waveguide components takes significant time. Especially when a user is experimenting with different components and needs the ability to remove and add components to a microwave apparatus quickly. Additionally, the screws may not apply equal pressure to all sides of the flange resulting in poor mating of the end portions of the waveguides such that the end portions of the rectangular waveguides do not meet on all sides such that a gap forms at the intersection. The performance of the a microwave apparatus that includes such a gap is reduced because of the radiation loss created by the gap.

The inventors have recognized and appreciated that a connector that allows quick attachment and applies even pressure around the circumference of the flanges of the waveguide components will provide better system performance and reduce the time it takes a user to connect and disconnect waveguide components. Specifically, in some embodiments, a female part that fits over a first rectangular waveguide and can freely rotate about the rectangular waveguide is connected, via an internal cylindrical threaded surface, to a male part that sits against the flange of a second rectangular waveguide and includes a threaded external surface. The female part fits over both the flange of the first rectangular waveguide, the flange of the second rectangular waveguide and at least a portion of the male part. The male part does not extend over the flange of the second waveguide. In this way, the overall diameter of the connector may be kept smaller than the diameter of a connector that has both the female part and male part fitting over a respective flange. Furthermore, with the female part fitting over the first rectangular waveguide, the flange of the second rectangular waveguide and at least a portion of the male part without the male part needing to fit over the flange of the second waveguide, a wider range of flange thicknesses may be accommodated. For example, the flange of the second waveguide could be thicker than a standard size and the connector, according to some embodiments, would still function to couple the two waveguides together.

In some embodiments, the male part has an axial opening that allows the male part quickly fit over the second rectangular waveguide. The male part may also include alignment pins that fit into alignment holes of the flange of the second rectangular waveguide, allowing the male part to sit stationary relative to the waveguide as the female part is rotated and the threads of the female part are engaged with the threads of the male part. Thus, a user can hold the two waveguides and the male part in place with one hand while rotating the female part with the other hand to quickly connect the waveguides together.

The inventors have further recognized and appreciated that the female part used to form a quick connector between two waveguides may be used to connect a waveguide to a variety of other components if a male adapter is used. Accordingly, some embodiments include a male part that attaches to any suitable microwave device. The microwave device may be a waveguide or an active microwave component. The male part includes an axial opening at the center that acts as a waveguide and couples microwave radiation from the waveguide into the microwave device. In some embodiments, the male part may be a flange adapter that attaches to the outer surface of a microwave device. In other embodiments, the male part may be a bulkhead adapter that fits into a hole in the outer surface of the microwave device such that one end of the male part is inside the microwave device and one end of the male part is outside the microwave device. In some embodiments, the male adapter includes the same threaded holes and alignment holes that would allow the conventional connection of waveguides using screws, similar to the connection illustrated in FIG. 1. This allows a user of a microwave component that include the male adapter part to connect a waveguide in either the conventional manner or using the female part of the present application. Thus, the inventors have developed a family of connectors and adapters that allow quick, convenient connection of various microwave components while maintaining backwards compatibility with conventional techniques for connecting components.

FIGS. 2-5 show a technique for engaging a waveguide connector assembly with a first waveguide component 110 and a second waveguide component 120 such that the microwave radiation guided by one waveguide is coupled to the other waveguide, according to some embodiments. The waveguide connector assembly includes a female part 210 and a male part 250. In some embodiments, the waveguide connector assembly is configured to couple any standardized waveguide components. For example, the waveguide components may be WR-10, WR-12 or WR-15 components.

Details of some embodiments of the waveguide connector assembly shown in FIGS. 2-5 are shown in FIGS. 6A-9E.

The female part 210 includes a first annular end surface 215 and a second annular end surface 216 opposed to and parallel to the first annular surface. The second annular end surface 216 may have a greater radial thickness than the first annular end surface 215. A center of the first annular end surface 215 and a center of the second annular end surface 216 define a female center axis, which itself defines a female axial direction.

The female part 210 further includes an external surface 212 and a threaded internal cylindrical surface 211. In some embodiments, the external surface 212 is also cylindrical, but it need not be. The threaded internal cylindrical surface 211 includes the inner radius of the first annular end surface 215. In some embodiments, where the annular end surface are the same width, the threaded internal cylindrical surface 211 may also include the inner radius of the second annular end surface 216. The threaded internal cylindrical surface 211 is configured to engage with a threaded external cylindrical surface of the male part, discussed below.

The female part 210 forms a hollow internal space defined by the threaded internal cylindrical surface. The hollow internal space has a width and height that are both larger than a largest cross-sectional dimension of the first rectangular waveguide 111 such that the female part 210 may rotate around the first rectangular waveguide 111.

Figure 3:
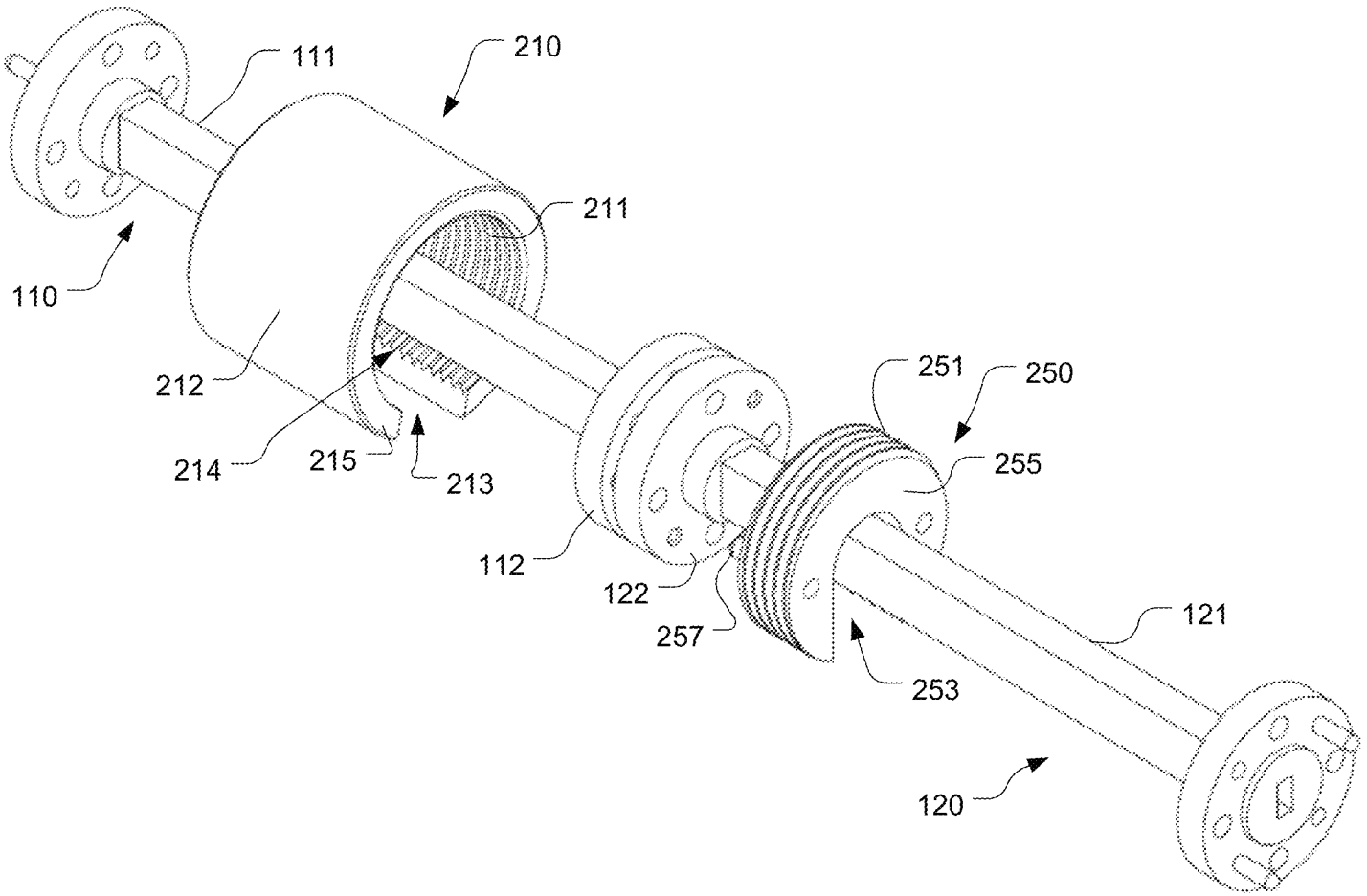
FIG. 3 is a perspective view of a waveguide connector assembly, according to some embodiments, engaged with two waveguide components.

The female part 210 includes a gap 213 in the threaded internal cylindrical surface that extends in the female axial direction from the first end annular end surface 215 to the second annular end surface 216, and extends in a female radial direction the entire width of the first annular end surface 215 and the second annular end surface 216, wherein the gap is wider than a width of the first rectangular waveguide 111. The gap 213 allows the female part 210 to fit over the first rectangular waveguide 111 such that the first rectangular waveguide 111 is within the hollow internal space 214, as shown in FIG. 3.

The male part 250 includes a threaded external cylindrical surface 251 that defines a male center axis that defines a male axial direction. The male part also includes a first end surface 254 and a second end surface 255. The first end surface 254 and a second end surface 255 are opposed to and parallel to one another.

In some embodiments, the male part 250 includes a male axial opening 253 that extends in the male axial direction from the first end surface 254 to the second end surface 255, and extends in a male radial direction from an edge of the first end surface to a location beyond the center of the first end surface. The male axial opening 253 has a cross-section that is larger than a width of the second rectangular waveguide 121 such that the second rectangular waveguide 121 fits within the male axial opening 253. In some embodiments, the male axial opening 253 is a U-shape. The U-shape may, for example include a semicircle portion near the center of the male part and straight lines that extend from the semicircle to the edge of the first end surface 255. In some embodiments, the male axial opening 253 causes the first end surface 254 and the second end surface 255 to have a partial circular shape. For example, the end surfaces may have an overall circular cross-section but for the male axial opening 253, where material was removed from the end surfaces to make the end surfaces only partial circles.

Figure 4:
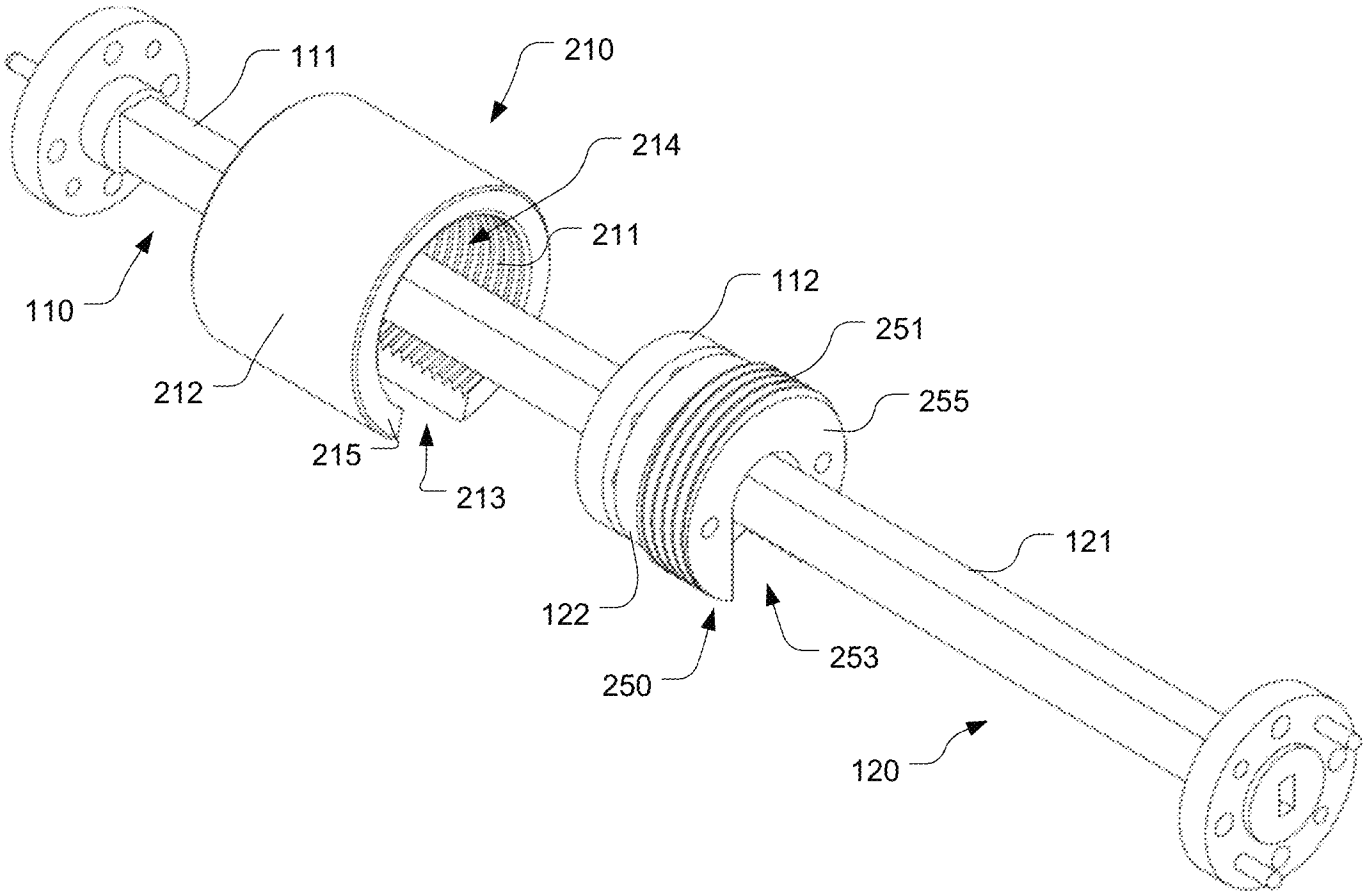
FIG. 4 is a perspective view of a waveguide connector assembly, according to some embodiments, with a male part of the waveguide connector assembly engaged with a flange of the second waveguide component.

In some embodiments, the first end surface 254 is configured to be in surface contact with the flange 122 of the second waveguide component 120. Here, surface contact means that at least a planar portion of the first end surface is in physical contact with a planar portion on the flange 122. In some embodiments, the male part 250 includes at least one alignment pin (e.g., alignment pins 256 and 257) configured to engage with alignment holes 131/132 and/or threaded holes 123/124 of the flange 122. FIG. 4 shows the waveguide connector assembly with the alignment pins 256/257 of the male part 250 engaged with the threaded holes 123/124. Note that the male part 250 does not surround or envelope the flange 122, but rests against it.

Figure 5:
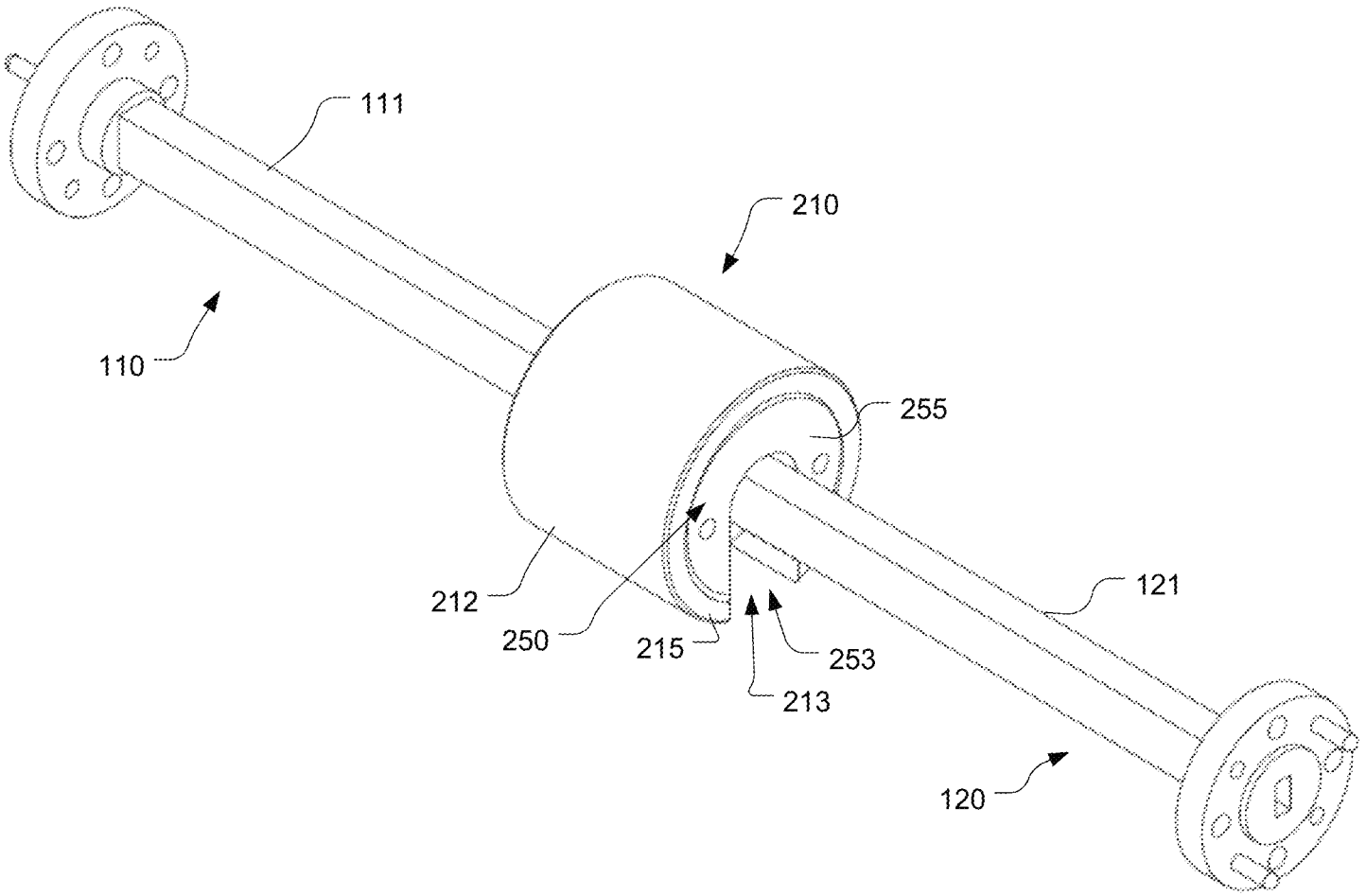
FIG. 5 a perspective view of a waveguide connector assembly, according to some embodiments, with the male part engaged with a female part of the waveguide connector assembly.
Figure 6A:
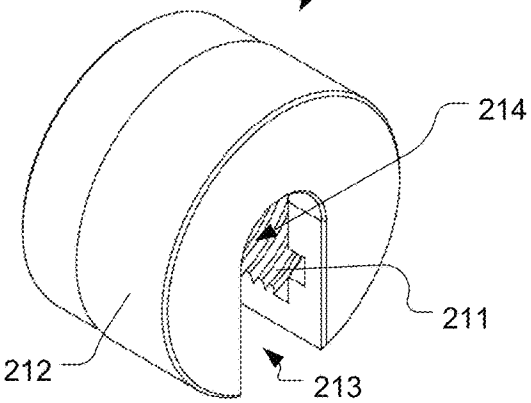
FIG. 6A a perspective view of a female part of a waveguide connector assembly, according to some embodiments.
Figure 6B:
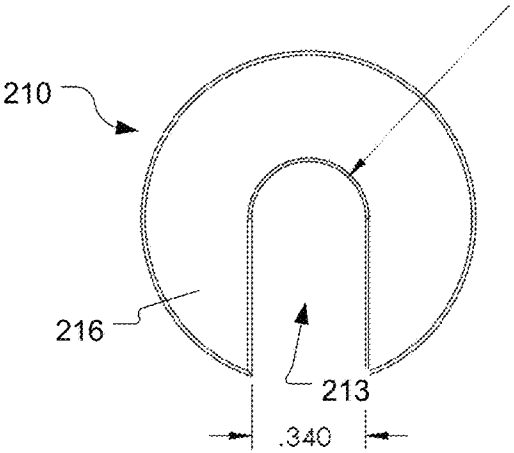
FIG. 6B is a back view of a female part of a waveguide connector assembly, according to some embodiments.
Figure 6D:
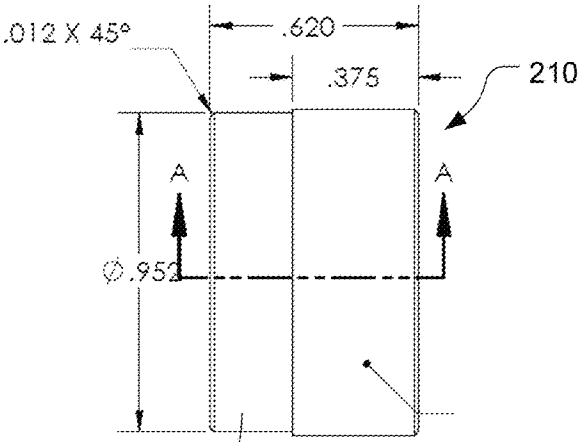
FIG. 6D is a side view of a female part of a waveguide connector assembly, according to some embodiments.
Figure 6E:
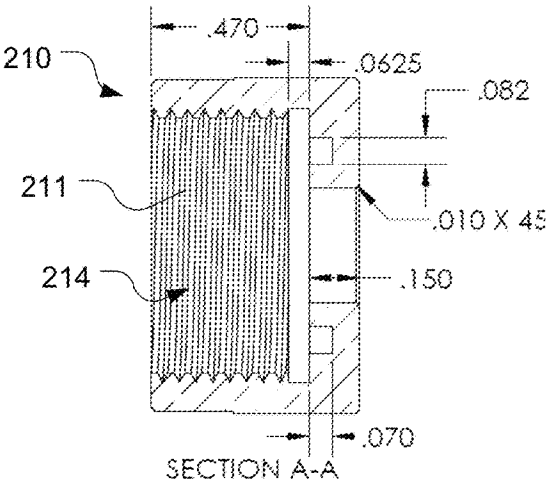
FIG. 6E is a cross-sectional view of a female part of a waveguide connector assembly, according to some embodiments.
Figure 6C:
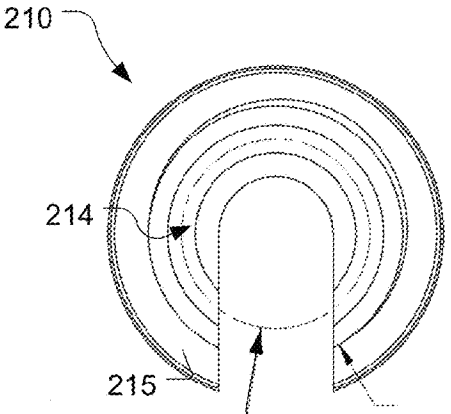
FIG. 6C is a front view of a female part of a waveguide connector assembly, according to some embodiments.
Figure 7A:
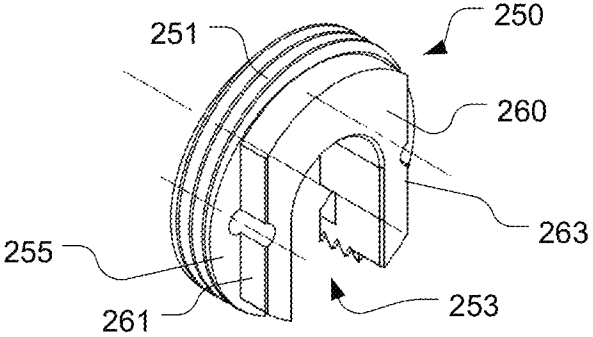
FIG. 7A a perspective view of a male part of a waveguide connector assembly, according to some embodiments.
Figure 7B:
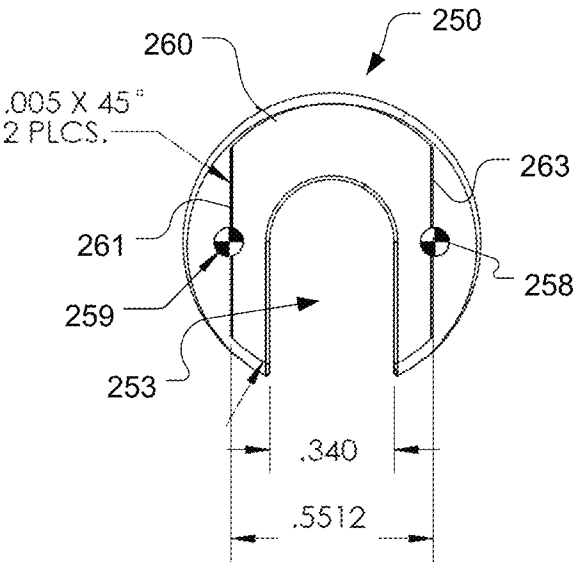
FIG. 7B is a back view of a male part of a waveguide connector assembly, according to some embodiments.
Figure 7E:
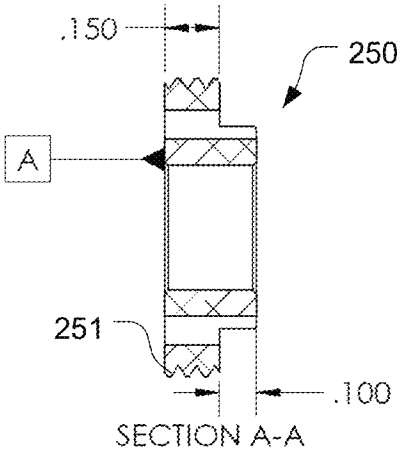
FIG. 7E is a cross-sectional view of a male part of a waveguide connector assembly, according to some embodiments.
Figure 7D:
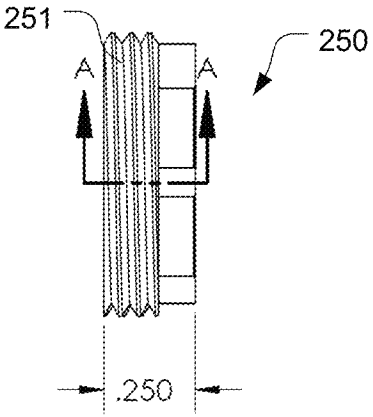
FIG. 7D is a side view of a male part of a waveguide connector assembly, according to some embodiments.
Figure 7C:
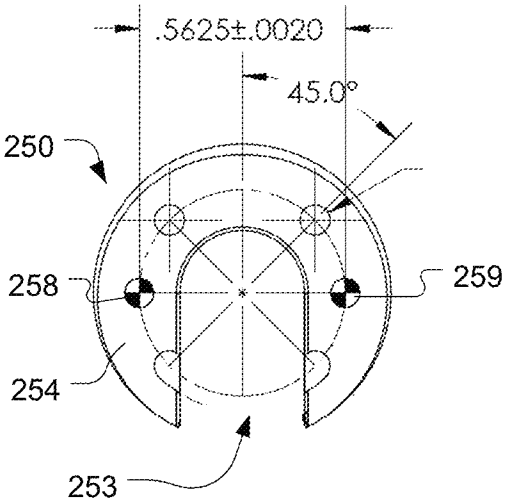
FIG. 7C is a front view of a male part of a waveguide connector assembly, according to some embodiments.
Figure 8A:
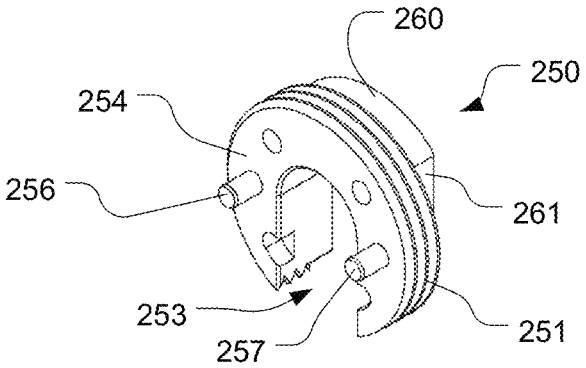
FIG. 8A is a front perspective view of a male part of a waveguide connector assembly with alignment pins, according to some embodiments.
Figure 8B:
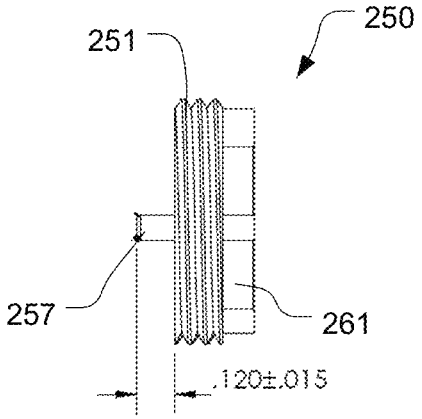
FIG. 8B is a side view of a male part of a waveguide connector assembly with alignment pins, according to some embodiments.
Figure 9A:
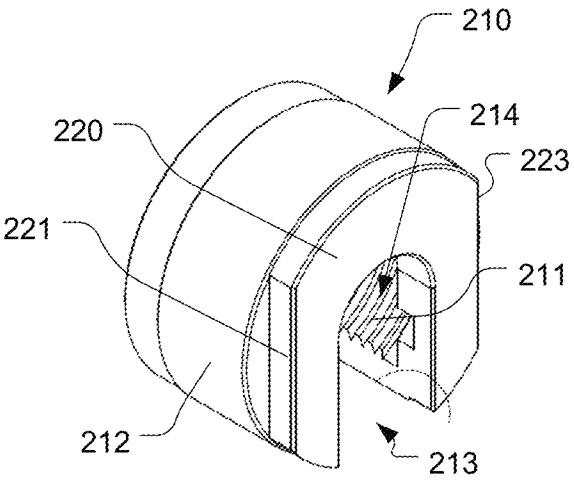
FIG. 9A a perspective view of a female part of a waveguide connector assembly with flats on the back, according to some embodiments.
Figure 9B:
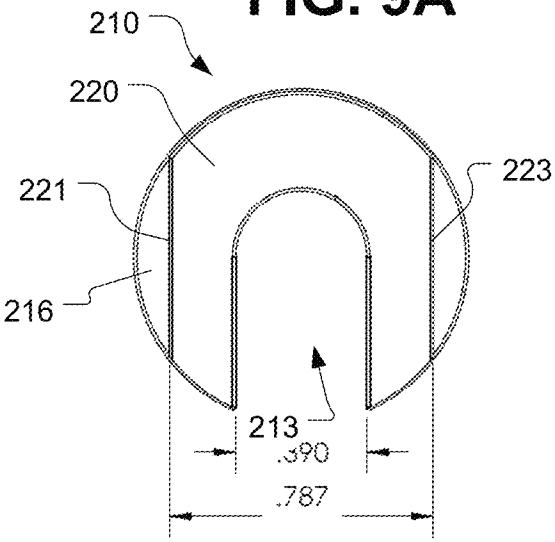
FIG. 9B is a back view of a female part of a waveguide connector assembly with flats on the back, according to some embodiments.
Figure 9D:
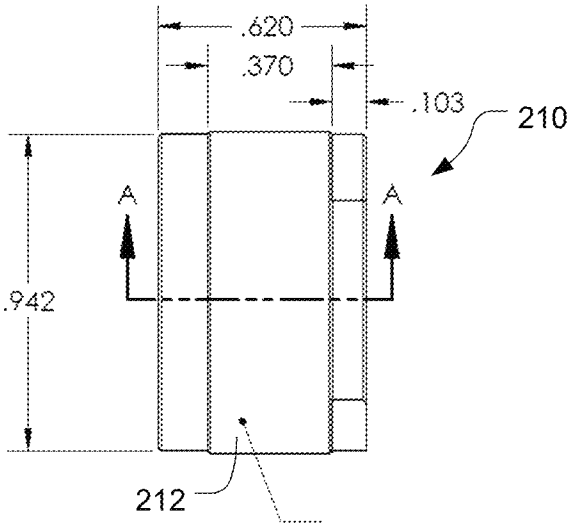
FIG. 9D is a side view of a female part of a waveguide connector assembly with flats on the back, according to some embodiments.
Figure 9E:
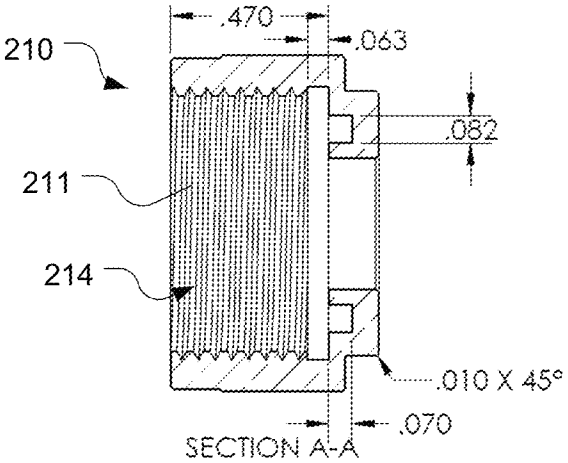
FIG. 9E is a cross-sectional view of a female part of a waveguide connector assembly with flats on the back, according to some embodiments.
Figure 9C:
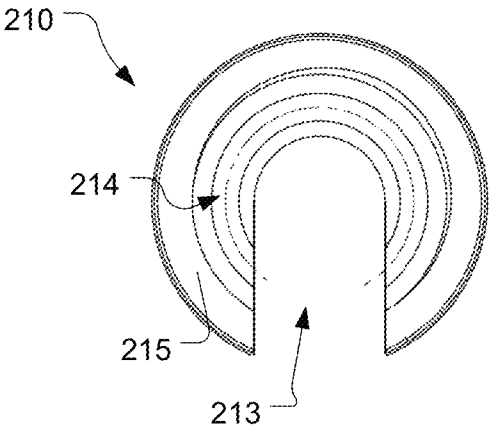
FIG. 9C is a front view of a female part of a waveguide connector assembly with flats on the back, according to some embodiments.

FIG. 5 illustrates the final position of the female part 210 and male part 250 after a user rotates the female part 210 such that the internal threaded surface 211 of the female part engages with the external threaded surface 251 of the male part. When fully engaged and tightened, surrounds the flange 112 of the first waveguide component 110 and the flange 122 of the second waveguide component 120 such that the flange 112 and the flange 122 are with the hollow space 214 of the female part 210. The male part 250 is also within the hollow space 214. In some embodiments, a portion of the male part may not be surrounded by the female part 210 and may extend from the first annular surface 215 of the female part 210.

In some embodiments, as illustrated in FIGS. 7A-E, the second end surface 255 of the male part 250 includes a raised portion 260 that forms two flats 261/263 configured to engage with a wrench. The flat 261 is parallel to the flat 263 and the two flats are formed from opposing edges of the raised portion 260. The raised portion 260 may extend from the female part 210 when fully tightened and engaged.

In some embodiments, as illustrated in FIGS. 9A-E, the second annular end surface 216 also includes a raised portion 220 that forms two flats 221/223 configured to engage with a wrench. The flat 221 is parallel to the flat 223 and the two flats are formed from opposing edges of the raised portion 220. When both the male part 250 and the female part 210 have flats, a calibrated torque wrench may be used to tighten the male part and the female part together with a precise torque value.

Figure 10:
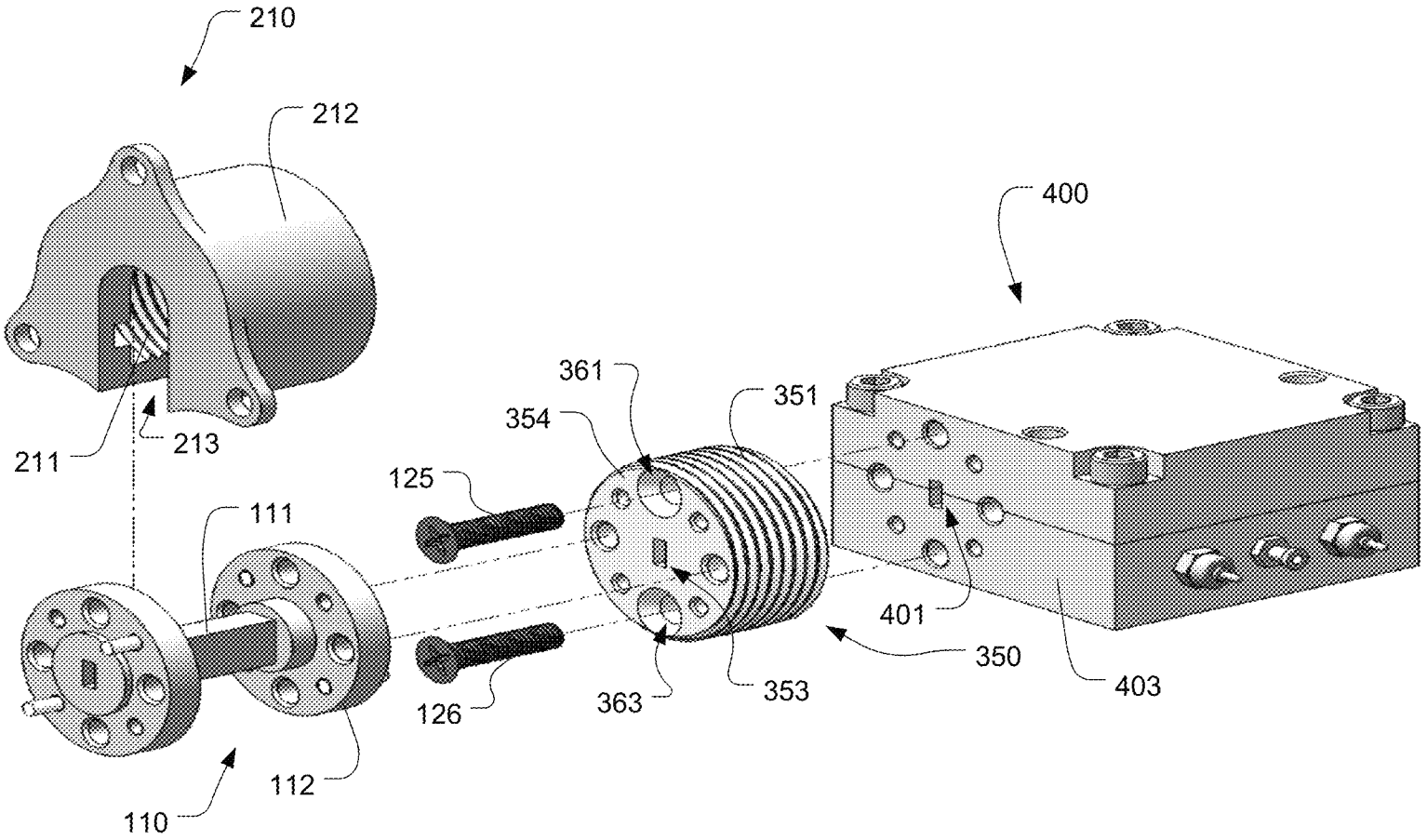
FIG. 10 is a perspective view of a waveguide connector assembly with a male flange adapter part, according to some embodiments.
Figure 11A:
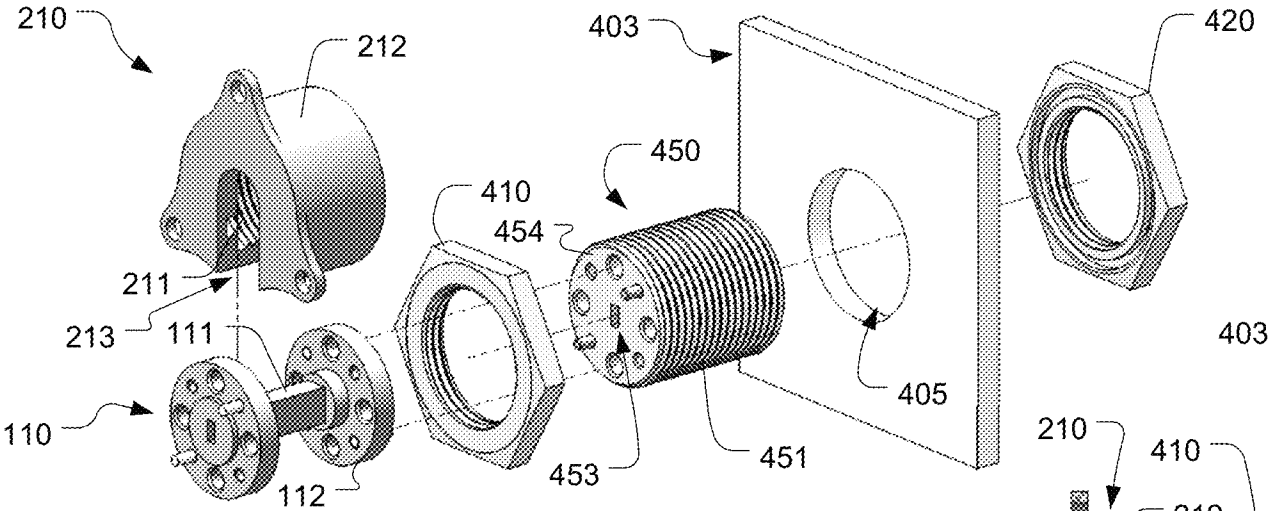
FIG. 11A is a perspective view of a waveguide connector assembly with a male bulkhead adapter part, according to some embodiments.
Figure 11B:
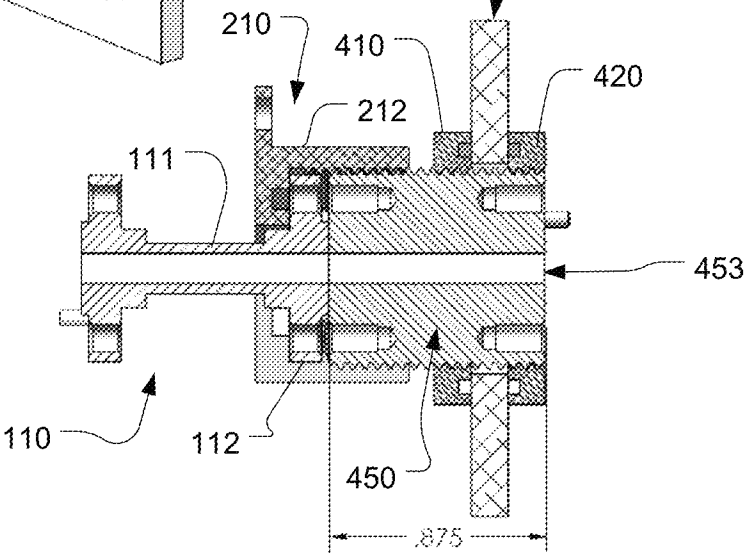
FIG. 11B is a cross-sectional view of a waveguide connector assembly with a male bulkhead adapter part engaged with a microwave component, according to some embodiments.
Figure 12C:
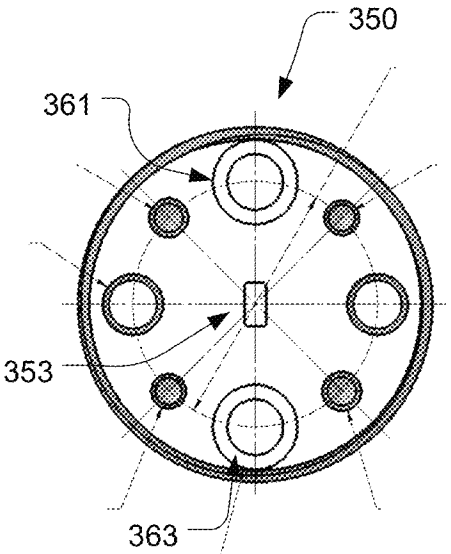
FIG. 12C is a front view of a male flange adapter part of a waveguide connector assembly, according to some embodiments.
Figure 12E:
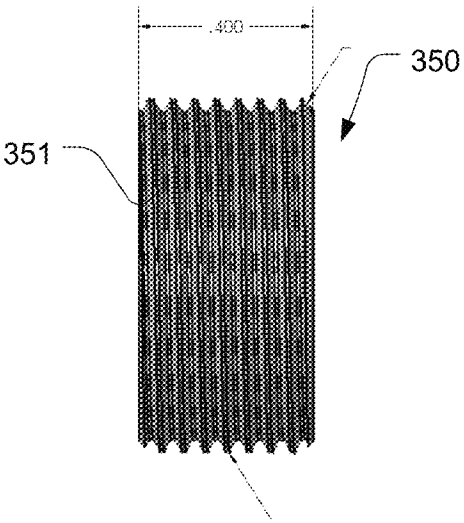
FIG. 12E is a side view of a male flange adapter part of a waveguide connector assembly, according to some embodiments.
Figure 12A:
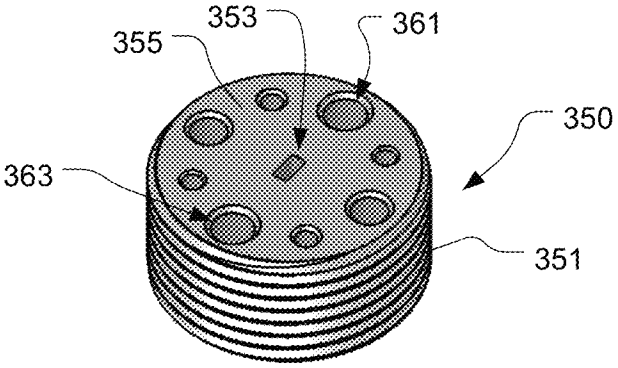
FIG. 12A a back perspective view of a male flange adapter part of a waveguide connector assembly, according to some embodiments.
Figure 12D:
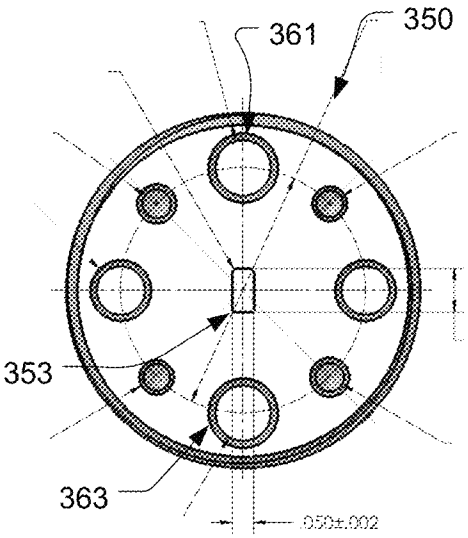
FIG. 12D is a back view of a male flange adapter part of a waveguide connector assembly, according to some embodiments.
Figure 12B:
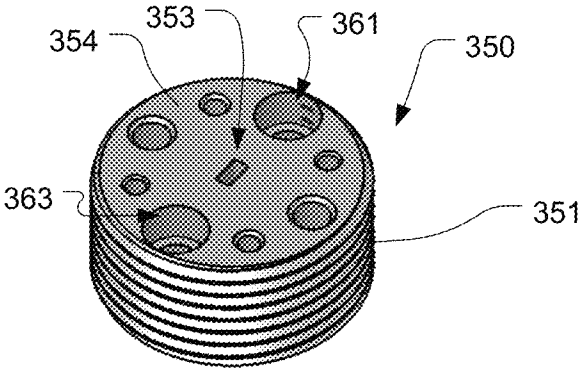
FIG. 12B is a front perspective view of a male flange adapter part of a waveguide connector assembly, according to some embodiments.
Figure 13A:
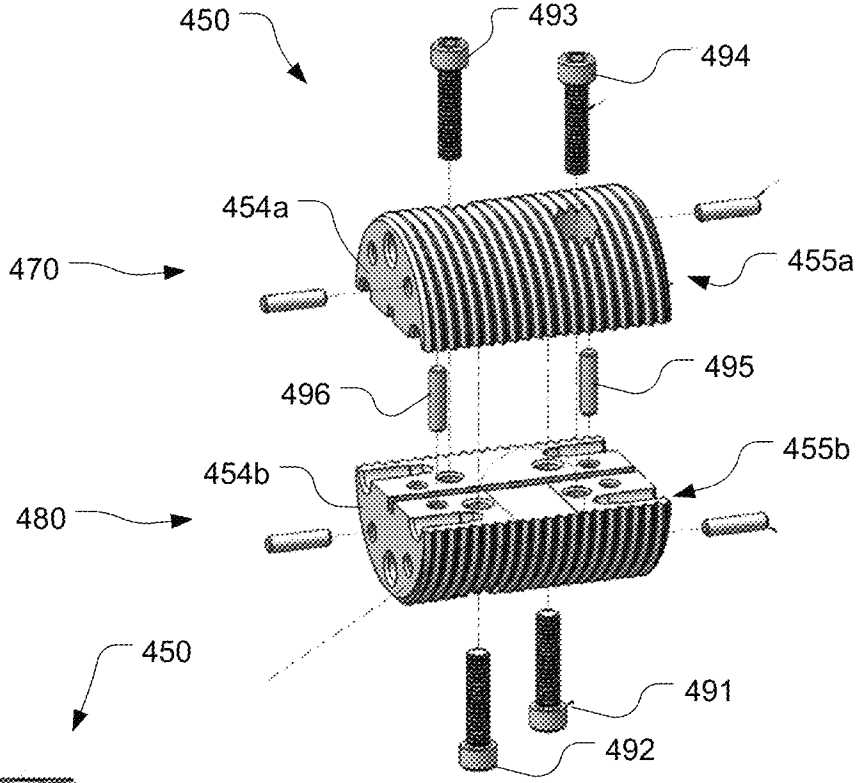
FIG. 13A a perspective exploded view of a male bulkhead adapter part of a waveguide connector assembly, according to some embodiments.
Figure 13D:
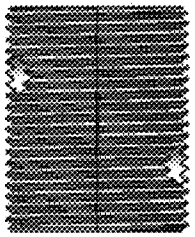
FIG. 13D is a side view of a male bulkhead adapter part of a waveguide connector assembly, according to some embodiments.
Figure 13B:
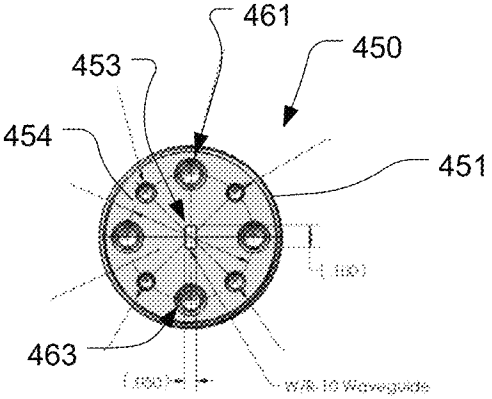
FIG. 13B is a front view of a male bulkhead adapter part of a waveguide connector assembly, according to some embodiments.
Figure 13C:
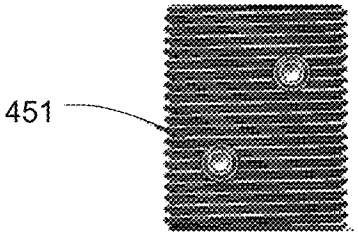
FIG. 13C is a top view of a male bulkhead adapter part of a waveguide connector assembly, according to some embodiments.
Figure 14C:
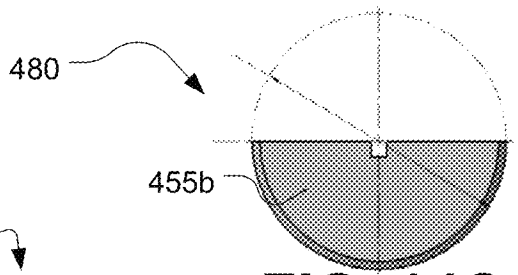
FIG. 14C is a back view of half of the male bulkhead adapter part of a waveguide connector assembly, according to some embodiments.
Figure 14D:
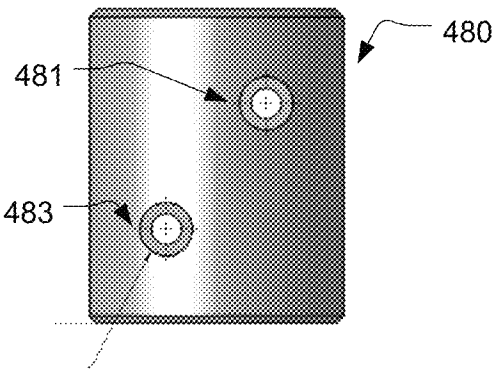
FIG. 14D is a bottom view of half of the male bulkhead adapter part of a waveguide connector assembly, according to some embodiments.
Figure 14B:
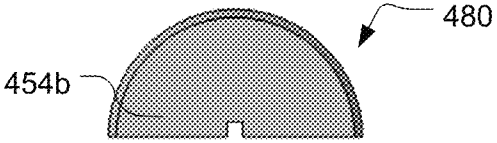
FIG. 14B is a front view of half of the male bulkhead adapter part of a waveguide connector assembly, according to some embodiments.
Figure 14E:
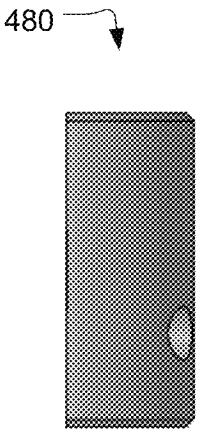
FIG. 14E is a side view of half of the male bulkhead adapter part of a waveguide connector assembly, according to some embodiments.
Figure 14F:
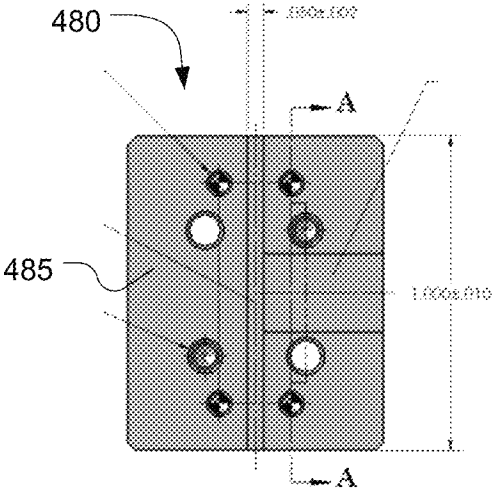
FIG. 14F is a top view of half of the male bulkhead adapter part of a waveguide connector assembly, according to some embodiments.
Figure 14A:
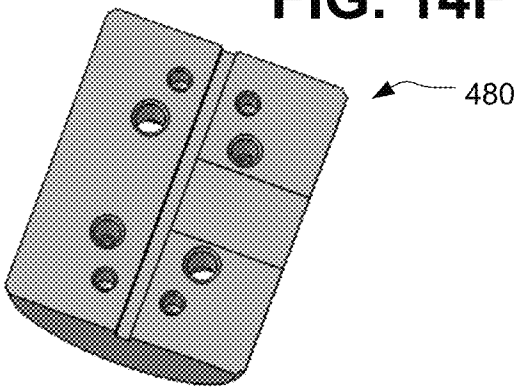
FIG. 14A a perspective view of half of the male bulkhead adapter part of a waveguide connector assembly, according to some embodiments.
Figure 14G:
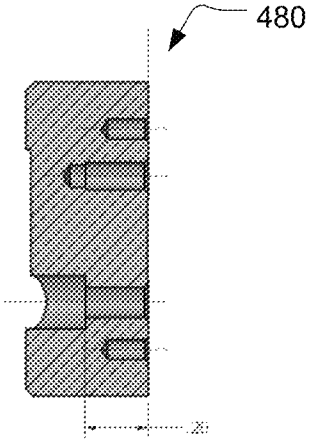
FIG. 14G is a cross-sectional view of half of the male bulkhead adapter part of a waveguide connector assembly, according to some embodiments.
Figure 15A:
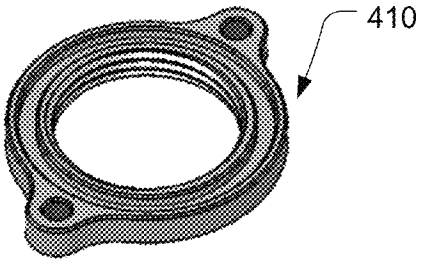
FIG. 15A a front perspective view of a nut for use with the male bulkhead adapter part of a waveguide connector assembly, according to some embodiments.
Figure 15B:
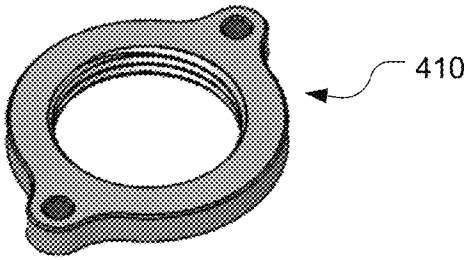
FIG. 15B is a back perspective view of a nut for use with the male bulkhead adapter part of a waveguide connector assembly, according to some embodiments.
Figure 15C:
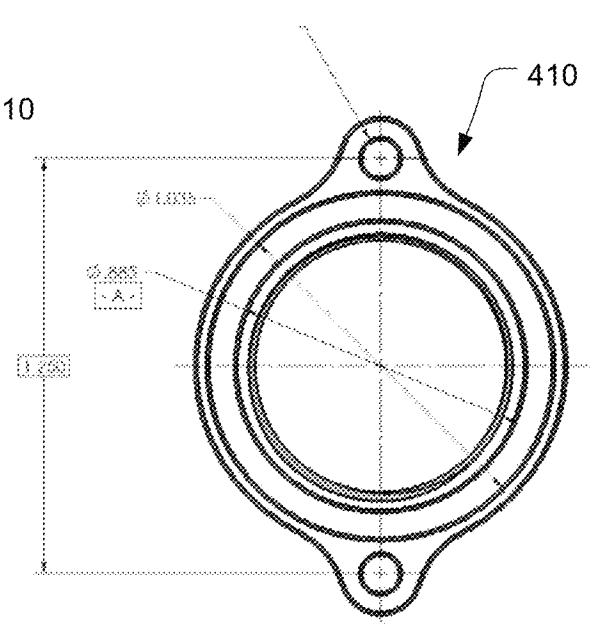
FIG. 15C is a front view of a nut for use with the male bulkhead adapter part of a waveguide connector assembly, according to some embodiments.
Figure 15D:
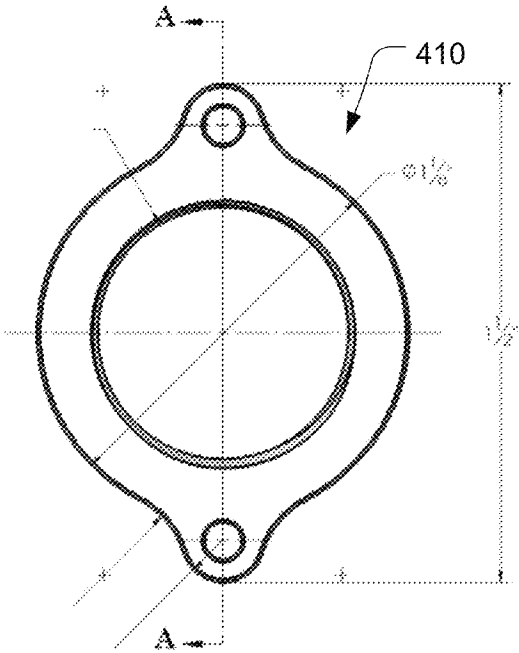
FIG. 15D is a back view of a nut for use with the male bulkhead adapter part of a waveguide connector assembly, according to some embodiments.
Figure 15E:
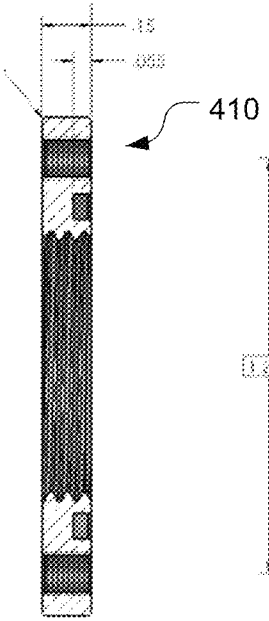
FIG. 15E is a cross-sectional view of a nut for use with the male bulkhead adapter part of a waveguide connector assembly, according to some embodiments.

FIG. 10 illustrates an embodiment where the male part 350 is a flange adapter configured to be attached to an outer surface 403 of a microwave device 400. FIG. 11 illustrates an embodiment where the male part 450 is a bulkhead adapter configured to be attached to a microwave device 400 by being placed within a hole 405 of the outer surface 403 of a microwave device 400. In both male part 350 and male part 450, the end surfaces are circular in shape and include a male axial opening 353 and 453, respectively, that extends in the male axial direction from the first end surface to the second end surface, is located at the center of the first end surface and the center of the second end surface, and is the same size and shape as the waveguide such that the male axial opening guides microwave radiation. Thus, both male parts 350 and 450 include a waveguide that guides microwave radiation through the male part itself, from the waveguide component 110 to the microwave device 400 and/or vice versa. Additionally, both male parts 350 and 450 have threaded external surfaces 351 and 451, respectively, that engage with the threaded internal surface 211 of the female part 210. Thus, the same female part may be used in waveguide connector assemblies that include male parts 250, 350 and/or 450.

In some embodiments, the male part 350 includes at least two threaded screw holes 361/363 that extend from a first end surface 354 to a second end surface 355 in a male axial direction and are configured to receive screws 125/126 that attach the male part 350 to the microwave device 350 such that a male axial opening 353 of the male part 350 is aligned with the waveguide hole 401 of the microwave device 400 and a second end surface 355 of the male part is in surface contact with the outer surface 403 of the microwave device 400. Thus, the male part 350 is entirely outside of the microwave device 400.

In some embodiments, the male part 450, is configured to be placed within a hole 405 of the outer surface 403 of the microwave device 400. The hole 405 is configured to receive the male part 450 by being a diameter that is the same or slightly larger than the diameter of the male part 450. In some embodiments, the male part 450 is held in place using two nuts. Thus, the waveguide connector assembly may include a first nut 410 configured to engage with the threaded external surface of the male part 450 outside the microwave device 400 and a second nut 420 configured to engage with the threaded external cylindrical surface of the male part 450 inside the microwave device 400. FIG. 15 illustrates the nut 410. The nut 420 may be the same or similar to the nut 410.

As illustrated in FIGS. 12A-E, showing male part 350, and FIGS. 13A-E, showing male part 450, the male part 350 includes threaded holes 361 and 363 for receiving screws that can connect the male part 350 to the waveguide component 110 and/or the microwave device 400 and the male part 450 includes threaded holes 461 and 463 for receiving screws that can connect the male part 450 to the waveguide component 110 and/or the microwave device 400. The male parts 350 and 450 may also include alignment holes for receiving alignment pins. The alignment holes may be located, for example, at a 45 degree angles in one or more directions relative to the flat surface of the male axial openings 353 and 453.

In some embodiments, the male parts 350 and 450 are monolithically formed. In other embodiments, the male part 450 is formed from a top part 470 and a bottom part 480, which are both halve cylinders. The top part 470 includes a first semicircular end surface 454*a* and a second semicircular end surface 455*a*. The bottom part 480 includes a first semicircular end surface 454*b* and a second semicircular end surface 455*b*. The top part 470 and the bottom part 480 are held together with at least one fastener (e.g., screws 491-494) such that the first semicircular end surface 454*a* and the second semicircular end surface 454*b* form the first end surface 454 of the male part 450 and the second semicircular end surface 455*a* and the fourth semicircular end surface 455*b* form the second end surface 455 of the male part 450. At least one alignment screw (e.g., alignment screws 495/496) may be used to align the top part 470 with the bottom part 480.

In some embodiments, forming the male part 450 from two separate halves (e.g., top part 470 and bottom part 480) allows a coating to be formed on the surface of the male axial opening 453. For example, the male part 450 may be formed from brass and the coating may be a gold coating. In some embodiments, forming the male part 450 from two separate halves allows one or more microwave components to be placed within the male axial opening 453. For example, an attenuator and/or a filter may be placed within the male axial opening 453 before attaching the top part 470 to the bottom part 480.

FIGS. 14A-14G illustrate an example of a bottom part 480. In some embodiments, the threaded external surface 451 is not formed when forming the bottom halve 480. The threading is added after the top part 470 is attached to the bottom part 480. The bottom part 480 includes recessed threaded holes through the external surface 451 that extend through to a flat surface 485 of the bottom part 480 and are configured to receive the screws used to attach the two halves. There are also a plurality of alignment holes in the flat surface 485 that do not extend all the way through to the external cylindrical surface 451. In some embodiments, the top part 470 is made in the same or similar way as the bottom part 480.

Having thus described several aspects of at least one embodiment of this invention, it is to be appreciated that various alterations, modifications, and improvements will readily occur to those skilled in the art.

For example, male part 450 is described as being formed from a top part 470 and a bottom part 480. Alternatively or additionally, the male part 350 may be formed from two halves in a similar way. Alternatively, the two halves may be left and right parts, not top and bottom parts.

Additionally, the waveguide connectors, adapters, and devices described herein may be used with electromagnetic radiation with frequencies ranging from 50 GHz to 500 GHz. Microwave components in this range have a standard size/shape of waveguides and flanges which may be used on and with any of the waveguide connectors, adapters, and devices described herein. For example, waveguides WR-15, WR-10, WR-08, WR-06, WR-05, WR-04, WR-03, WR-2.8, and WR-2.2 may be used, and flange types UG-385, UG-387/U, and UG-387/U-M may be used. In some embodiments, the waveguide connectors, adapters, and devices may use waveguides and flanges that correspond with particular frequency bands within the 50-500 GHz range. For example, waveguide WR-15 may be used for frequencies 50 to 75 GHz with the Flange UG-385; waveguide WR-12 may be used for frequencies 60 to 90 GHz with the Flange UG-387/U; waveguide WR-10 may be used for frequencies 75 to 110 GHz with the Flange UG-387/U-M; waveguide WR-08 may be used for frequencies 90 to 140 GHz with the Flange UG-387/U-M; waveguide WR-06 may be used for frequencies 110 to 170 GHz with the Flange UG-387/U-M; waveguide WR-05 may be used for frequencies 140 to 220 GHz with the Flange UG-387/U-M; waveguide WR-04 may be used for frequencies 170 to 260 GHz with the Flange UG-387/U-M; waveguide WR-03 may be used for frequencies 220 to 325 GHz with the Flange UG-387/U-M; waveguide WR-2.8 may be used for frequencies 325 to 400 GHz with the Flange UG-387/U-M; and waveguide WR-2.2 may be used for frequencies 400 to 500 GHz with the Flange UG-387/U-M.

Such alterations, modifications, and improvements are intended to be part of this disclosure, and are intended to be within the spirit and scope of the invention. Further, though advantages of the present invention are indicated, it should be appreciated that not every embodiment of the invention will include every described advantage. Some embodiments may not implement any features described as advantageous herein and in some instances. Accordingly, the foregoing description and drawings are by way of example only.

Various aspects of the present invention may be used alone, in combination, or in a variety of arrangements not specifically discussed in the embodiments described in the foregoing and is therefore not limited in its application to the details and arrangement of components set forth in the foregoing description or illustrated in the drawings. For example, aspects described in one embodiment may be combined in any manner with aspects described in other embodiments.

Use of ordinal terms such as "first," "second," "third," etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified.

As used herein in the specification and in the claims, the phrase "equal" or "the same" in reference to two values (e.g., distances, widths, etc.) means that two values are the same within manufacturing tolerances. Thus, two values being equal, or the same, may mean that the two values are different from one another by ±5%.

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

What is claimed is:

1. A waveguide connector assembly for coupling a waveguide to a microwave device, the waveguide comprising at least one flange at an end of the waveguide, the waveguide connector assembly comprising:

a male part comprising:

a threaded external cylindrical surface defining a male center axis that defines a male axial direction;

a first end surface; and a second end surface opposed to the first end surface; and a female part comprising:

a first annular end surface;

a second annular end surface opposed to the first annular end surface, wherein a center of the first annular end surface and a center of the second annular end surface define a female center axis that defines a female axial direction;

a threaded internal cylindrical surface configured to engage with the threaded external cylindrical surface of the male part, the internal cylindrical surface including an inner radius of the first annular end surface;

a hollow internal space defined by the threaded internal cylindrical surface, wherein the hollow internal space has a width and height that are both larger than a largest cross-sectional dimension of the waveguide; and a gap in the threaded internal cylindrical surface that extends in the female axial direction from the first end annular end surface to the second annular end surface, and extends in a female radial direction the entire width of the first annular end surface and the second annular end surface, wherein the gap is wider than a width of the waveguide, wherein a length of the female part in the female axial direction is greater than a length of the male part in the male axial direction.

2. The waveguide connector assembly of claim 1, wherein the waveguide is a first waveguide and the microwave device is a second waveguide comprising a flange at an end of the second waveguide, the male part further comprising:

a male axial opening that extends in the male axial direction from the first end surface to the second end surface, and extends in a male radial direction from an edge of the first end surface to a location beyond the center of the first end surface, wherein the male axial opening has a cross-section that is larger than a width of the second waveguide.

3. The waveguide connector assembly of claim 2, wherein the first end surface and the second end surface have a partial circular shape.

4. The waveguide connector assembly of claim 3, wherein the male axial opening is U-shaped with an open end of the U-shaped opening being at the edge of first end surface and the second end surface creating the partial circular shape.

5. The waveguide connector assembly of claim 2, wherein the first end surface of the male part is configured to be in surface contact with the flange at the end of the second waveguide.

6. The waveguide connector assembly of claim 2, wherein the male part comprises at least two alignment pins extending in the male axial direction from the first end surface.

7. The waveguide connector assembly of claim 2, wherein when the male part is engaged in the female part to couple the first waveguide to the second waveguide the at least one flange of the first waveguide, the flange of the second waveguide, and at least a portion of the male part are within the hollow internal space of the female part.

8. The waveguide connector assembly of claim 2, wherein the first end surface of the male part includes a raised portion that forms two flats configured to engage with a wrench.

9. The waveguide connector assembly of claim 1, wherein the male part further comprises:

a male axial opening that extends in the male axial direction from the first end surface to the second end surface, is located at the center of the first end surface and the center of the second end surface, and is the same size and shape as the waveguide such that the male axial opening guides microwave radiation.

10. The waveguide connector assembly of claim 9, wherein the microwave device includes a waveguide hole in an outer surface of the microwave device and the male part further comprises:

at least two threaded screw holes that extend from the first end surface to a second end surface in the male axial direction and are configured to receive screws that attach the male part to the microwave device such that the male axial opening of the male part is aligned with the waveguide hole of the microwave device and the second end surface of the male part is in surface contact with the outer surface of the microwave device.

11. The waveguide connector assembly of claim 9, wherein the microwave device includes a hole in an outer surface of the microwave device configured to receive the male part such that the first end surface of the male part is outside the microwave device and the second end surface of the male part is inside the microwave device, and the waveguide connector assembly further comprises:

a first nut configured to engage with the threaded external cylindrical surface of the male part outside the microwave device; and a second nut configured to engage with the threaded external cylindrical surface of the male part inside the microwave device, wherein, when engage, the first nut and the second nut hold the male part in place inside the hole in the outer surface of the microwave device.

12. The waveguide connector assembly of claim 9, wherein the first end surface and the second end surface are circular in shape.

13. The waveguide connector assembly of claim 12, wherein the male part comprises:

a first cylindrical segment having a first semicircular end surface and a second semicircular end surface opposed to the first semicircular end surface; and a second cylindrical segment having a third semicircular end surface and a fourth semicircular end surface opposed to the third semicircular end surface; and at least one fastener that holds the first cylindrical segment and the second cylindrical segment together such that the first semicircular end surface and the second semicircular end surface form the first end surface of the male part and the second semicircular end surface and the fourth semicircular end surface form the second end surface of the male part.

14. The waveguide connector assembly of claim 9, wherein the first end surface of the male part comprises:

at least two threaded screw holes that extend from the first end surface into the male part in the male axial direction and are configured to receive screws that attach the male part to the at least one flange of the waveguide.

15. The waveguide connector assembly of claim 9, wherein the first end surface of the male part comprises:

at least two alignment holes that extend from the first end surface into the male part in the male axial direction and are configured to receive alignment pins of the waveguide.

16. The waveguide connector assembly of claim 1, wherein the threaded external cylindrical surface of the male part extends the entire length of the male part.

17. The waveguide connector assembly of claim 1, wherein the length of the female part in the female axial direction is greater than the length of the male part in the male axial direction.

18. The waveguide connector assembly of claim 1, wherein a radial width of the second annular end surface of the female part is greater than a radial width of the first annular end surface of the female part.

19. The waveguide connector assembly of claim 18, wherein the male part and/or the female part include two flats configured to engage with a wrench.

20. A female locking mechanism for coupling a waveguide to a microwave device, the waveguide comprising at least one flange at an end of the waveguide, the female locking mechanism comprising:

an first annular end surface;

a second annular end surface opposed to the first annular surface, wherein a center of the first annular end surface and a center of the second annular end surface define a female center axis that defines a female axial direction;

a threaded internal cylindrical surface including an inner radius of the first annular end surface;

a hollow internal space defined by the threaded internal cylindrical surface, wherein the hollow internal space has a width and height that are both larger than a largest cross-sectional dimension of the first waveguide; and a gap in the threaded internal cylindrical surface that extends in the female axial direction from the first end annular end surface to the second annular end surface, and extends in a female radial direction an entire radial width of the first annular end surface and an entire radial width of the second annular end surface, wherein the gap is wider than a width of the waveguide.

* * * * *